US008484941B2

(12) United States Patent
Malafaya Oliveira Sá

(10) Patent No.: US 8,484,941 B2
(45) Date of Patent: Jul. 16, 2013

(54) METHOD OF ACCOMPLISHMENT OF A HYBRID CORD

(75) Inventor: Miguel Lages Malafaya Oliveira Sá, Oporto (PT)

(73) Assignee: WireCo WorldGroup Inc., Kansas City, MO (US)

( * ) Notice: Subject to any disclaimer, the term of this patent is extended or adjusted under 35 U.S.C. 154(b) by 0 days.

(21) Appl. No.: 13/182,622

(22) Filed: Jul. 14, 2011

(65) Prior Publication Data

US 2012/0015208 A1 Jan. 19, 2012

(30) Foreign Application Priority Data

Jul. 14, 2010 (PT) ..... 105197

(51) Int. Cl.
*D02G 3/36* (2006.01)

(52) U.S. Cl.
USPC ..... 57/230

(58) Field of Classification Search
USPC ..... 57/210, 230, 231, 238, 23
See application file for complete search history.

(56) References Cited

U.S. PATENT DOCUMENTS

| | | | | |
|---|---|---|---|---|
| 3,824,777 | A * | 7/1974 | Riggs | 57/214 |
| 3,874,158 | A * | 4/1975 | Chiappetta et al. | 57/214 |
| 4,197,695 | A * | 4/1980 | Hughes et al. | 57/7 |
| 4,202,164 | A * | 5/1980 | Simpson et al. | 57/232 |
| 4,219,995 | A * | 9/1980 | Tajima et al. | 57/220 |
| 4,422,286 | A * | 12/1983 | Simpson et al. | 57/221 |
| 4,887,422 | A * | 12/1989 | Klees et al. | 57/220 |
| 5,651,245 | A * | 7/1997 | Damien | 57/220 |
| 6,658,836 | B2 * | 12/2003 | Nguyen et al. | 57/218 |
| 7,036,298 | B2 * | 5/2006 | Honda | 57/214 |
| 7,389,633 | B2 * | 6/2008 | Misrachi | 57/223 |
| 7,565,791 | B2 * | 7/2009 | Itaya | 57/237 |
| 2004/0069132 | A1 | 4/2004 | Knudsen et al. | |
| 2008/0289312 | A1 * | 11/2008 | Takada | 57/232 |
| 2011/0189411 | A1 * | 8/2011 | Elad et al. | 428/34.1 |

FOREIGN PATENT DOCUMENTS

WO WO 2007036938 A2 * 4/2007

* cited by examiner

*Primary Examiner* — Shaun R Hurley
(74) *Attorney, Agent, or Firm* — Husch Blackwell LLP

(57) ABSTRACT

The present invention relates to a method of accomplishment of a hybrid cord comprising an inner layer (1) in steel cord, an intermediate layer (2) in a high module and high toughness fiber and an outer layer (3) in a Polyolefin fiber. The present invention also refers to its application in an 8 (4×2) cords braided hybrid cable or any other type of hybrid cable presenting another construction, in braided or twisted cables.

16 Claims, 2 Drawing Sheets

METHOD OF ACCOMPLISHMENT OF A HYBRID CORD

CROSS-REFERENCE TO RELATED APPLICATIONS

This application claims priority of Portuguese Patent Application No. 105197 filed on Jul. 14, 2010, the disclosures of which is incorporated herein by reference.

SCOPE OF INVENTION

The present invention relates to a method of accomplishment of a hybrid cord made up of three layers and elements:

steel in the inner layer

High module fibre and high toughness in the middle layer polyolefin fiber in outer layer.

This cord can be applied to a hybrid 8 cords (4×2) braided cable or to any other type of hybrid cable with a different construction, in braided or twisted cables.

BACKGROUND OF THE INVENTION

Mixed common cables are well-known used for lifting loads, comprising a core of steel cords or cables to support the load, and an outer layer of fibre mainly designed to protect the core.

From the known technique reference is made to U.S. Patent No. US2004/0069132 which disclosed a cable for applications to lifting heavy loads, which uses a mixture of Fibres of High Module and Tenacity, unlike the present invention that combines elements of steel and a Fibre of High Module and Tenacity. Principles are different in that each requires a different approach in balancing the different elements, as well as in manufacturing processes.

Several patents and other means describe methods of accomplishment and manufacture of mixed common cables.

ADVANTAGES OF THE INVENTION

The application of hybrid braided cord in a hybrid cable, allows, comparatively to other common mixed cables or common steel cables, a better balance between cable weight reduction and greater cable flexibility is achieved, which allows this type of cable to be used in situations where another type of cable can not be used, such as lifting loads of deep ocean floor in great depth.

This advantage is obtained by replacing part of steel core for a fibre of high module and tenacity, which enables a substantial reduction in weight on the cable, while maintaining its density higher than that of water, or negative buoyancy, an essential characteristic for an hybrid cable with sea applications.

The high module and high toughness fibre contributes effectively to reduce the breaking load. In common mixed cables, fibre when applied outside the cable and/or cord has essentially a protective function (of steel), and when applied inside of the cable and/or cord (core) its contribution to the breaking load can be considered marginal. That is, its role is primarily of protection and weight reduction (by replacing part of the steel elements), and not load support.

The replacement of the cord core only made of steel by a steel+high fibre core of high module and tenacity allows the intermediate fibre also to have a role in supporting the load, since being a high module and high toughness fibre with mechanical characteristics near the steel, works in conjunction with the element in steel, also contributing to a reduction of weight due to its low density.

This substitution allows an increase in real breaking Force and the work Force, since by decreasing the weight of the cable it is possible to increase the load to be lifted. That is, associated with high resistance to rupture, low weight allows for a longer cable to lift the same load, or having the same cable length it is possible to lift a heavier load since the breaking length is superior (useful breaking force superior in relation to a common mixed cable, for two reasons: low weight and superior resistance to breakage).

With this structure, the braided hybrid cable, revealed by the present invention, compared with 8 (4×2) cords braided common mixed cables has the following advantages:

In a common mixed cable steel element makes up approximately 68% of the total weight of the cable, while in the hybrid cable steel element represents approximately 60% of the total weight of the cable, while high module and high toughness fibre represents only 17%;

The weight of this hybrid cable is less than 24%, compared to a common mixed cable;

In the hybrid cable, regarding the breaking force, steel element represents only 31% of the breaking force of the cable;

The breaking force is about two times higher than the breaking force of a common mixed cable of the same diameter.

This hybrid cable allows to reduce the weight and metal section, and thus to increase the minimum breaking force of approximately 2 times compared to a common mixed cable.

In cyclic loading tests with prototype a residual charge was obtained after 1000 cycles, about 15% higher than the average breaking load obtained in breakage test.

BRIEF DESCRIPTION OF THE DRAWINGS

These and other features can be easily understood through the attached drawings, which must be regarded merely as examples and in any way restrictive to the scope of the invention.

DETAILED DESCRIPTION OF INVENTION

Figure 1:
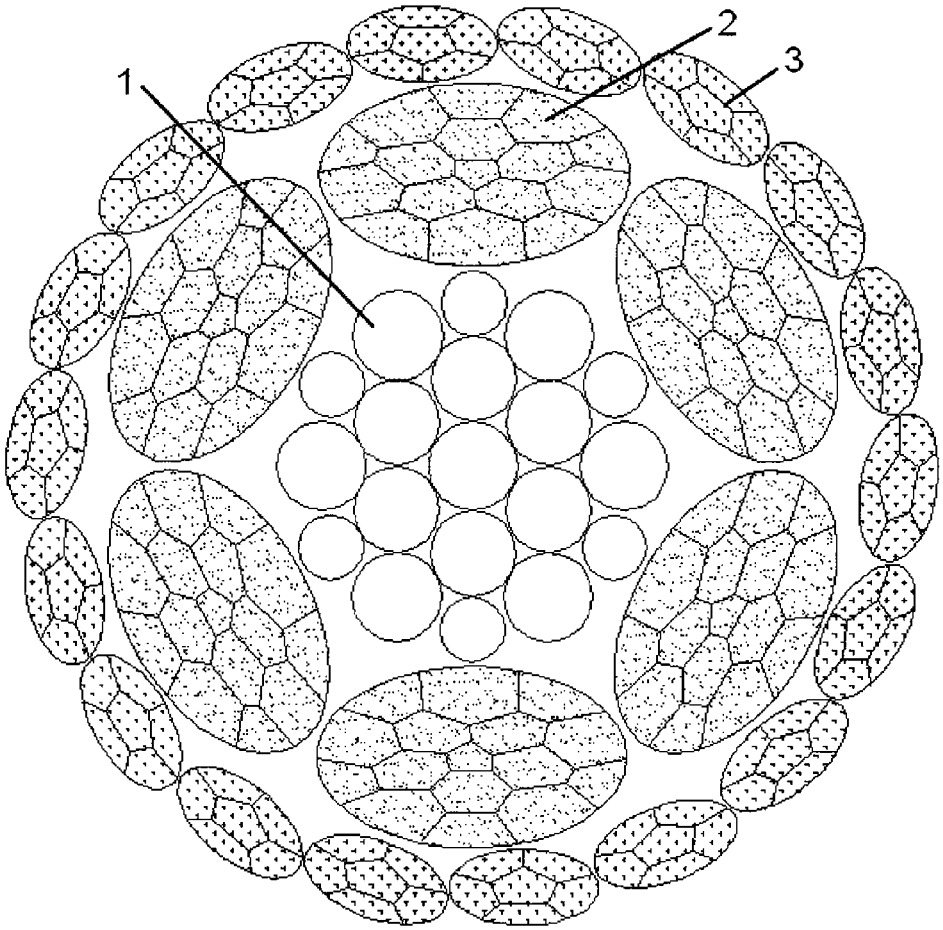
FIG. 1 shows a cross-sectional view of the section of the cords that constitute the hybrid cable, being visible the disposal of several elements: cord core 1, intermediate layer 2 and outer layer 3.
Figure 2:
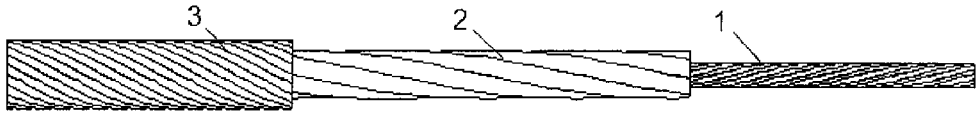
FIG. 2 shows a cross-sectional view of the cords that constitute the hybrid cable, being visible several elements disposal: cord core 1, intermediate layer 2 and outer layer 3.

The present invention relates to a method of accomplishment of a hybrid cord made up of three elements and layers, as illustrated in FIGS. 1 and 2:

Core 1 for load support consisting of steel cord formed by steel wires

Intermediate layer 2 for load support consisting of a high-module and high tenacity fibre selected among HPME fibre (High Modulus Polyethylene), LCP fibre (Liquid Crystal Polymer), Aramid fibre (Aromatic Polyamide)

Outer layer 3 protective of intermediate layer 2 consisting of fibre with high resistance to abrasion between fibres that are in contact with metal surfaces, particularly polyolefin or a high strength polypropylene or polyethylene fibre, such as Polysteel®.

These cords are manufactured using techniques known for manufacture of common mixed cords made of steel and polyolefin, where the latter plays a protective function of steel.

Figure 3:
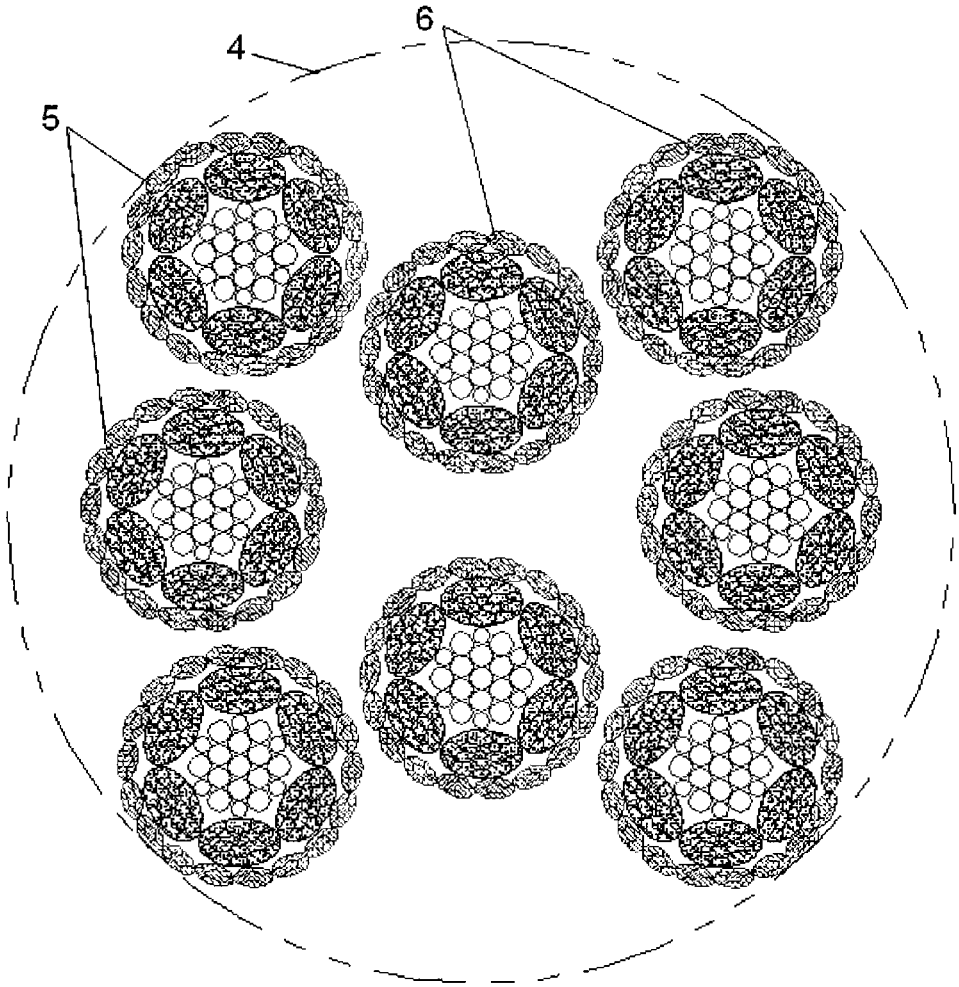
FIG. 3 shows a cross-sectional view of section of the hybrid cable 4 consisting of 4 cords with twist direction Z (right) 5 and 4 cords with twist direction S (left) 6.
Figure 4:
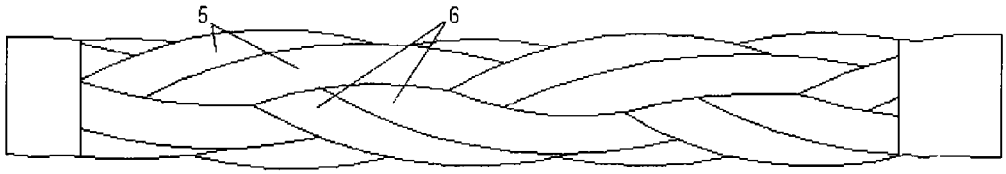
FIG. 4 shows a cross-sectional view of the hybrid cable, in which a twist direction Z (right) 5 cords and a twist direction S (left) 6 cords are visible.

As depicted in FIGS. 3 and 4, this cord has a preferred application in a hybrid cable 4 of 8 strands (4×2) twisted. In its construction, using techniques already known two pairs of cords with twist direction Z (right) 5 and two pairs of cords with twist direction S (left) 6 are placed.

Cords with Z 5 twist are composed of fibres with spinning in S and steel cord in S. Cords with S twist are composed of fibres with spinning in Z and steel cord in Z.

This cord can also be applied to any other type of hybrid cable showing another construction, in braided cables or twisted cables.

The invention claimed is:

1. Hybrid cord comprising:

a steel cord inner layer spirally arranged;

a high modulus fibre intermediate layer that is spirally arranged over said inner layer; and a polyolefin or a polypropylene or polyethylene fibre outer layer that is spirally arranged over said intermediate layer.

2. Hybrid cord according to claim 1 wherein said steel cord inner layer is formed by steel wire galvanized or not.

3. Hybrid cord according to claim 1 wherein said fibre intermediate layer is one among:

HMPE fibre (High Modulus Polyethylene)

LCP fibre (Liquid Crystal Polymer)

Aramid fibre (Aromatic Polyamide).

4. Hybrid cord according to claim 1 wherein said fibre outer layer is a protective and abrasion resistant layer between said fibre intermediate layer and metal surfaces.

5. The hybrid cord according to claim 1 wherein said intermediate layer is spirally arranged in an opposite configuration as said inner layer and wherein said outer layer is spirally arranged in an opposite configuration as said intermediate layer.

6. The hybrid cord according to claim 1 wherein said steel cord inner layer is about 60% by weight of the total weight of said hybrid cord and wherein said fibre intermediate layer is about 17% by weight of the total weight of said hybrid cord.

7. A hybrid cord comprising:

an inner layer of galvanized or non-galvanized steel wires spirally arranged;

an intermediate layer of high modulus fibre spirally arranged over said inner layer; and an outer layer of polyolefin, polypropylene or polyethylene fibre spirally arranged over said intermediate layer.

8. The hybrid cord of claim 7 wherein said intermediate layer is made of HMPE fibre (High Modulus Polyethylene), LCP fibre (Liquid Crystal Polymer), or Aramid fibre (Aromatic Polyamide).

9. The hybrid cord of claim 7 wherein said outer layer is a protective and abrasion resistant layer between said intermediate layer and metal surfaces.

10. The hybrid cord of claim 7 wherein said intermediate layer is spirally arranged in an opposite configuration as said inner layer and wherein said outer layer is spirally arranged in an opposite configuration as said intermediate layer.

11. The hybrid cord of claim 7 wherein said steel cord inner layer is about 60% by weight of the total weight of said hybrid cord and wherein said fibre intermediate layer is about 17% by weight of the total weight of said hybrid cord.

12. A cable comprising:

a plurality of hybrid cords, each said hybrid cord having an inner layer of galvanized or non-galvanized steel wires spirally arranged; an intermediate layer of fibre high modulus spirally arranged over said inner layer; and an outer layer of polyolefin, polypropylene or polyethylene fibre spirally arranged over said intermediate layer.

13. The cable of claim 12 having a configuration wherein about fifty percent of each of said plurality of hybrid cords are twisted in a clockwise configuration and about fifty percent of each of said plurality of hybrid cords are twisted in a counter-clockwise configuration.

14. The cable of claim 12 wherein said plurality of hybrid cords is eight.

15. The cable of claim 14 wherein four of said plurality of hybrid cords are twisted in a clockwise configuration and four of said plurality of hybrid cords are twisted in a counter-clockwise configuration.

16. The cable of claim 15 having a braided arrangement of said clockwise configured hybrid cords and said counter-clockwise hybrid cords.

* * * * *

UNITED STATES PATENT AND TRADEMARK OFFICE

CERTIFICATE OF CORRECTION

PATENT NO. : 8,484,941 B2
APPLICATION NO. : 13/182622
DATED : July 16, 2013
INVENTOR(S) : Miguel Lages Malafaya Oliveira Sá

It is certified that error appears in the above-identified patent and that said Letters Patent is hereby corrected as shown below:

On the Title Page

(75) Inventor should read: Miguel Lages Malafaya Oliveira Sá, Porto (PT)

Signed and Sealed this
Third Day of September, 2013

Teresa Stanek Rea
*Acting Director of the United States Patent and Trademark Office*